US012292055B1

(12) United States Patent
Zhang et al.

(10) Patent No.: US 12,292,055 B1
(45) Date of Patent: May 6, 2025

(54) COMBINED BLADE DEVICE AND COMBINED AIR OUTLET DEVICE

(71) Applicant: XUXIN TECHNOLOGY (SHENZHEN) GROUP CO., LTD, Shenzhen (CN)

(72) Inventors: Ping Zhang, Shenzhen (CN); Shanxian Hu, Shenzhen (CN); Xinglin Sun, Shenzhen (CN); Huizhu Zhou, Shenzhen (CN); Yelin Sun, Shenzhen (CN); Lanying Luo, Shenzhen (CN)

(73) Assignee: XUXIN TECHNOLOGY (SHENZHEN) GROUP CO., LTD, Shenzhen (CN)

( * ) Notice: Subject to any disclaimer, the term of this patent is extended or adjusted under 35 U.S.C. 154(b) by 0 days.

(21) Appl. No.: 18/677,102

(22) Filed: May 29, 2024

Related U.S. Application Data

(63) Continuation of application No. PCT/CN2022/134892, filed on Nov. 29, 2022.

(30) Foreign Application Priority Data

Dec. 29, 2021 (CN) ..... 202111639861.0

(51) Int. Cl.
*F04D 29/30* (2006.01)
*F04D 17/08* (2006.01)
*F04D 29/28* (2006.01)

(52) U.S. Cl.
CPC ..... *F04D 29/30* (2013.01); *F04D 17/08* (2013.01); *F04D 29/281* (2013.01)

(58) Field of Classification Search
CPC ..... F04D 17/08; F04D 17/162; F04D 25/06; F04D 25/0606; F04D 25/064;
(Continued)

(56) References Cited

U.S. PATENT DOCUMENTS

2005/0260070 A1 11/2005 Hsu et al.
2008/0292464 A1 11/2008 Keber et al.

FOREIGN PATENT DOCUMENTS

CN 102227562 A 10/2011
CN 102322430 A * 1/2012 ..... F04D 29/281
(Continued)

OTHER PUBLICATIONS

JP_2007154685 translation (Year: 2007).*
(Continued)

*Primary Examiner* — Brian P Wolcott
(74) *Attorney, Agent, or Firm* — Westbridge IP LLC

(57) ABSTRACT

Disclosed are a combined blade device and a combined air outlet device. The combined blade device includes a hub, diagonal flow blades, and centrifugal blades, where a first air inlet is formed outside an edge of a first end of the hub, and a first air outlet is formed outside an edge of a second end of the hub, the hub is internally provided with a centrifugal cavity, the first end of the hub is provided with a second air inlet, the first air inlet surrounds the second air inlet, the second end of the hub is provided with a second air outlet, both the second air inlet and the second air outlet are communicated with the centrifugal cavity, and the hub expands gradually in a direction from the second air inlet to the second air outlet.

11 Claims, 7 Drawing Sheets

(58) Field of Classification Search
CPC ..... F04D 25/16; F04D 25/166; F04D 29/26; F04D 29/263; F04D 29/281
See application file for complete search history.

(56) References Cited

FOREIGN PATENT DOCUMENTS

| | | | | | |
|---|---|---|---|---|---|
| CN | 202370865 | U | * | 8/2012 | ..... F04D 25/082 |
| CN | 106015037 | A | | 10/2016 | |
| CN | 108291555 | A | | 7/2018 | |
| CN | 112594212 | A | | 4/2021 | |
| CN | 114233680 | A | | 3/2022 | |
| CN | 216812271 | U | | 6/2022 | |
| EP | 2058525 | A1 | | 5/2009 | |
| JP | H0921398 | A | * | 1/1997 | |
| JP | 2007154685 | A | * | 6/2007 | |
| JP | 2007154702 | A | * | 6/2007 | |
| JP | 3169805 | U | | 8/2011 | |
| JP | 2012107561 | A | | 6/2012 | |
| WO | WO-2023047849 | A1 | * | 3/2023 | ..... F04D 29/30 |

OTHER PUBLICATIONS

CN_102322430 translation (Year: 2012).*
CN_202370865 translation (Year: 2012).*
JP_2007154702 translation (Year: 2007).*
JP_H0921398 translation (Year: 1997).*
WO_2023047849 translation (Year: 2023).*
International Search Report and Written Opinion issued in corresponding PCT Application No. PCT/CN2022/134892, dated Feb. 27, 2023.
First Office Action issued in counterpart Chinese Patent Application No. 202111639861.0, dated Dec. 18, 2024.

* cited by examiner

COMBINED BLADE DEVICE AND COMBINED AIR OUTLET DEVICE

CROSS-REFERENCE TO RELATED APPLICATIONS

The present disclosure is a continuation application of International Application No. PCT/CN2022/134892, filed on Nov. 29, 2022, which claims priority to Chinese Patent Application No. 202111639861.0, filed Dec. 29, 2021. The disclosures of the above-mentioned applications are incorporated herein by reference in their entireties.

TECHNICAL FIELD

The present disclosure relates to a combined blade device and a combined air outlet device.

BACKGROUND

The statements herein merely provide background information related to the present disclosure and do not necessarily constitute the prior art.

Traditional high-air-pressure and high-speed fans are generally diagonal flow fans, hubs are disposed in the middles of diagonal flow blades, and air can only enter from the outsides of the hubs, which causes the diagonal flow fans to have some invalid air inlet areas, affecting the air inlet volumes of the diagonal flow fans. Moreover, the air forms turbulence in those areas, interfering with normal air intakes of the diagonal flow fans, and affecting the air pressures and air outlet volumes of the diagonal flow fans.

SUMMARY

The present disclosure aims to solve at least one of the technical problems existing in the prior art. To this end, the present disclosure provides a combined blade device and a combined air outlet device, and the air pressure and air volume of the air outlet device can be improved by making full use of air inlet areas of blades.

According to an embodiment in a first aspect of the present disclosure, a combined blade device includes:

- a hub, where a first air inlet is formed outside an edge of a first end of the hub, and a first air outlet is formed outside an edge of a second end of the hub, the hub is internally provided with a centrifugal cavity, the first end of the hub is provided with a second air inlet, the first air inlet surrounds the second air inlet, the second end of the hub is provided with a second air outlet, both the second air inlet and the second air outlet are communicated with the centrifugal cavity, and the hub expands gradually in a direction from the second air inlet to the second air outlet;
- at least one diagonal flow blade, connected to one side of the hub that is away from the centrifugal cavity; and
- at least one centrifugal blade, connected to the hub and located in the centrifugal cavity, where rotating axes of the at least one diagonal flow blade and the at least one centrifugal blade coincide with each other.

The combined blade device according to the embodiment of the present disclosure has at least the following beneficial effects.

In the embodiment of the present disclosure, an air inlet side of the hub is provided with the second air inlet, the first air inlet is formed outside the edge of the first end of the hub, thus the air inlet volume can be increased by making full use of the air inlet area at the air inlet side of the hub; undisturbed streams at the air inlet side of the hub facilitate the air entry, to improve the working efficiency of the air outlet device. Moreover, the diagonal flow blade and centrifugal blade can form two the airflows respectively, and the two airflows converge after being discharged from the respective air outlets, to effectively increase the air volume and air pressure of the air outlet device.

According to some embodiments of the present disclosure, the combined blade device further includes an adapter part, the at least one centrifugal blade includes a plurality of centrifugal blades, and ends of at least part of the centrifugal blades that are away from the first air outlet are connected to the adapter part.

According to some embodiments of the present disclosure, the part of the centrifugal blades connected to the adapter part and the part of the centrifugal blades not connected to the adapter part are spaced alternately in a circumferential direction of the hub.

According to some embodiments of the present disclosure, a plurality of adapter parts are provided and distributed at intervals, and in a plane perpendicular to the rotating axis of the centrifugal blades, projections of the adapter parts are located outside a projection of the first end of the hub.

According to some embodiments of the present disclosure, the plurality of adapter parts are evenly spaced in the circumferential direction of the hub.

According to an embodiment in a second aspect of the present disclosure, a combined air outlet device includes:

- the combined blade device in the embodiment of the first aspect;
- an air deflector in which at least part of the combined blade device is arranged; and
- a driving element, connected to the combined blade device and configured to drive the combined blade device to rotate.

The combined air outlet device according to the embodiment of the present disclosure has at least the following beneficial effects.

In the embodiment of the present disclosure, the air deflector is disposed around the hub and forms air ducts with the hub, which can make full use of the air inlet area at the air inlet side of the air outlet device, and the airflows generated by the centrifugal blade and diagonal flow blade converge after being discharged from the first air outlet and the second air outlet, to increase the air volume and air pressure of the air outlet device.

According to some embodiments of the present disclosure, an area enclosed by the air deflector and the outside of the edge of the first end of the hub is the first air inlet, and an area enclosed by the air deflector and the outside of the edge of the second end of the hub is the first air outlet.

According to some embodiments of the present disclosure, the combined air outlet device further includes a base, connected to one side of the centrifugal blade that are away from the second air inlet, and configured to mount the driving element.

According to some embodiments of the present disclosure, an edge of the base that is away from the rotating axis is flush with the second end of the hub in a direction of the rotating axis.

According to some embodiments of the present disclosure, the air deflector is provided with a first air guide section and a second air guide section, the first air guide section is disposed around the hub, the second air guide section is disposed around the base and blocks the second air outlet in the radial direction of the hub, the second air guide section is configured to guide the airflows discharged from the first air outlet and the second air outlet, and at least part of the second air guide section is parallel to the rotating axis.

According to some embodiments of the present disclosure, an inner surface of a joint of the first air guide section and the second air guide section is a curved surface, and the curved surface gradually approaches the second air outlet in the flowing direction of the airflow.

According to some embodiments of the present disclosure, the combined air outlet device further includes a mounting seat, the mounting seat is connected to one side of the base that is away from the hub, the air deflector further includes a third air guide section connected to one end of the second air guide section that is away from the first air inlet, the third air guide section is disposed around the mounting seat, and both the third air guide section and a part of the mounting seat are parallel to the rotating axis.

According to some embodiments of the present disclosure, the mounting seat includes a drainage part and a mounting part, the mounting part is connected to one side of the base that is away from the hub, the drainage part is connected to an outer edge of the mounting part that is away from the rotating axis, and the drainage part is parallel to the rotating axis and extends in a direction away from the base.

According to some embodiments of the present disclosure, the combined air outlet device further includes guide vanes, an air guide cavity is formed between the third air guide section and the mounting seat, and the guide vanes are accommodated in the air guide cavity and connected between the third air guide section and the mounting seat.

Additional aspects and advantages of the present disclosure will be elaborated in the description which follows, and will be partially apparent from the description, or understood by practice of the present disclosure.

BRIEF DESCRIPTION OF THE DRAWINGS

To better clarify the embodiments of the present disclosure or the technical solution in the prior art, the drawings required to illustrate the embodiments or the prior art will be simply described below. It is apparent that the drawings described below merely illustrate some embodiments of the present disclosure. Those of ordinary skill in the art can obtain other drawings according to these drawings without making creative efforts on the basis of those drawings.

DETAILED DESCRIPTION OF THE EMBODIMENTS

Figure 1:
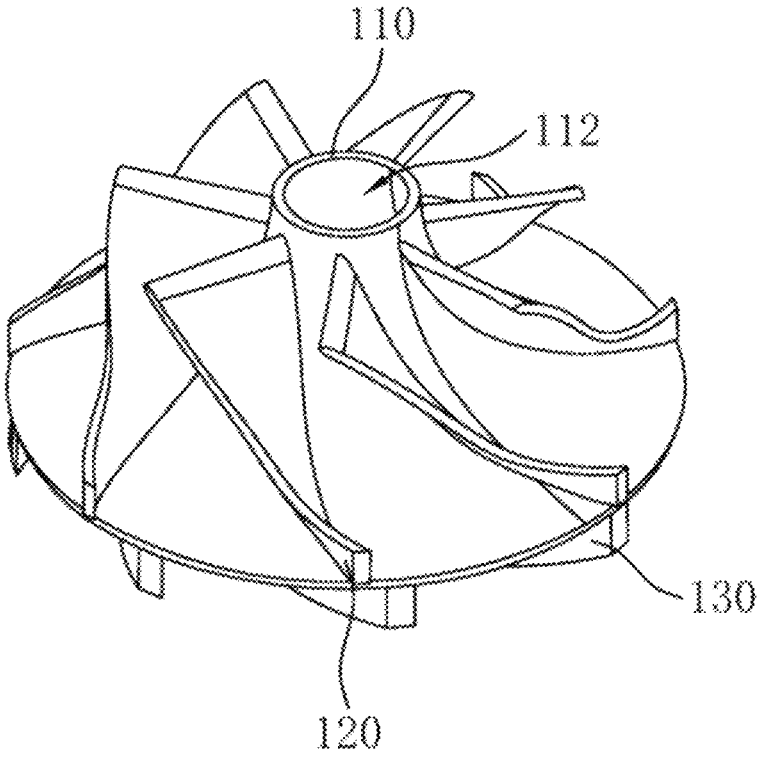
FIG. 1 is a schematic structural diagram showing a combined blade device according to some embodiments of the present disclosure.

The embodiments of the present disclosure are described in detail below, examples of which are shown in the drawings, the same or similar reference signs throughout indicate the same or similar components or components with same or similar function. The embodiments described with reference to the drawings are exemplary, which are merely used to explain the present disclosure, instead of being understood as a limitation to the present disclosure.

In the description of the present disclosure, it is understood that orientation or position relationships indicated by the terms "upper", "lower", "front", "rear", "left", and "right", and the like are based on the orientation or position relationships as shown in the drawings, for ease of describing the present disclosure and simplifying the description only, rather than indicating or implying that the mentioned apparatus or element necessarily has a particular orientation and must be constructed and operated in the particular orientation. Therefore, these terms should not be understood as limitations to the present disclosure.

In the description of the present disclosure, the meaning of "several" is one or more, the meaning of "a plurality" is two or more; "greater than", "less than", "exceeding" and the like are understood as excluding the original number, and "above", "below", "within" and the like are understood as including the original number. The described "first" and "second" are merely used for distinguishing technical features, instead of being understood as indicating or implying relative importance or impliedly indicating the quantity of the showed technical features or impliedly indicating the precedence relationship of the showed technical features.

In the description of the present disclosure, unless otherwise explicitly limited, the terms "set", "install", "connect" and the like should be generally understood. Those of ordinary skill in the art may reasonably determine the specific meaning of the terms in the present disclosure in combination with the specific contents of the technical solution.

In the description of the present disclosure, the description with reference to the terms "some embodiments", "schematic embodiment", "example", "specific example", or "some examples" and the like means that the specific characteristics, structures, materials or features described in combination with the embodiment or example are included in at least some embodiments or examples of the present disclosure. In this specification, the schematic expression of the above terms does not necessarily refer to the same embodiment or example. Moreover, the described specific characteristics, structures, materials or features may be combined in one or more embodiments or examples in a suitable manner.

Figure 2:
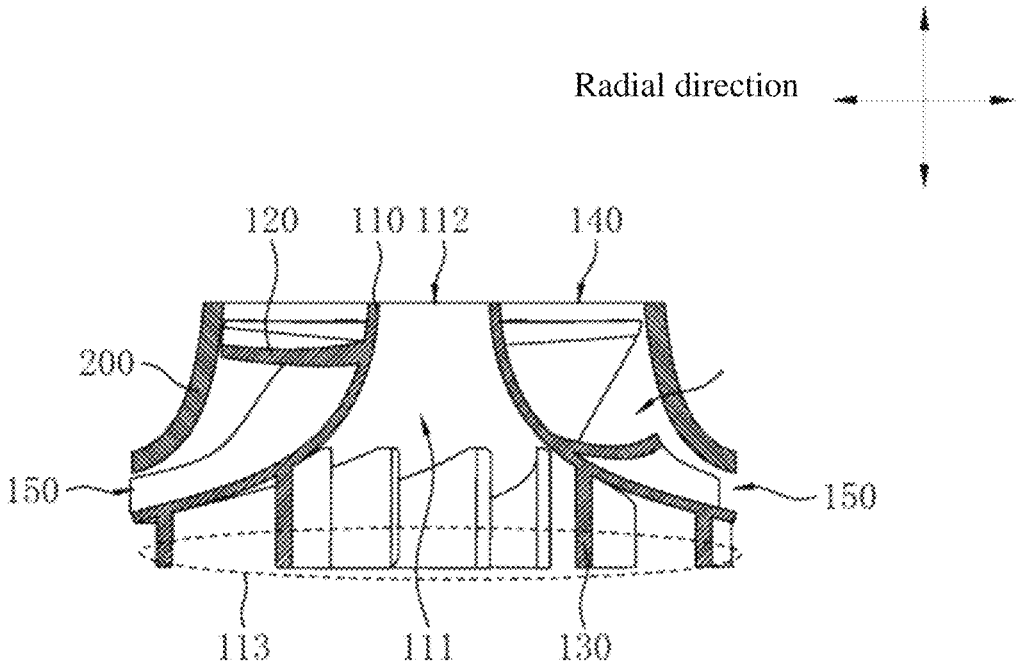
FIG. 2 is a schematic structural diagram showing cooperation of the combined blade device in FIG. 1 with an air deflector according to some embodiments of the present disclosure.

An embodiment of the present disclosure provides a combined blade device 100, which can be used in conjunction with an air deflector 200 to provide relatively independent air ducts for different blades, facilitating the airflow formed by the blades in the air ducts 160 and enabling the airflow to converge after formation. Specifically, as shown in FIG. 1, the combined blade device 100 includes a hub 110, diagonal flow blades 120, and centrifugal blades 130. As shown in FIG. 2, the air deflector 200 is arranged around the hub 110, a first air inlet 140 is formed between a first end of the hub 110 and the air deflector 200, a first air outlet 150 is formed between a second end of the hub 110 and the air deflector 200, and the air ducts 160 where the diagonal flow blades 120 form the airflow are formed in a gap between the air deflector 200 and the hub 110. The hub 110 is internally provided with a centrifugal cavity, the centrifugal blades 130 are located in the centrifugal cavity 111 and connected to the hub 110. The diagonal flow blades 120 are connected to the hub 110 at one side away from the centrifugal cavity 111, so that the diagonal flow blades 120 and the centrifugal blades 130 are disposed inside and outside the hub 110, respectively. The central axes of the hub 110, the diagonal flow blades 120, the centrifugal blades 130, and the air deflector 200 coincide with one another.

A first end of the hub 110 is provided with a second air inlet 112, the first air inlet 140 is disposed around the second air inlet 112, a second end of the hub 110 is provided with a second air outlet 113, and both the second air inlet 112 and the second air outlet 113 are communicated with the centrifugal cavity 111.

Figure 3:
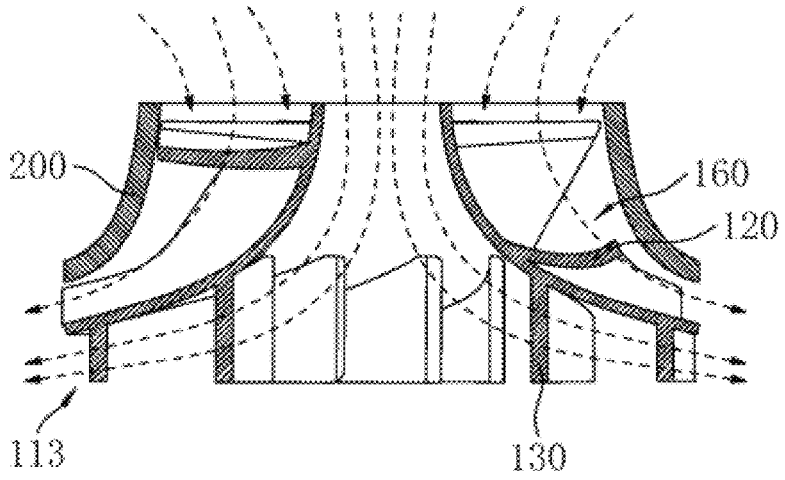
FIG. 3 is a schematic diagram showing a flowing direction of airflow in the combined blade device in FIG. 2 according to some embodiments of the present disclosure.

As shown in FIG. 3, the hub 110 gradually and externally expands in a direction from the second air inlet 112 to the second air outlet 113, the rotating axis of the diagonal flow blades 120 coincides with that of the centrifugal blades 130, such that the diagonal flow blades 120 are superimposed and combined with the diagonal flow blades 120 in an axial direction. When the combined blade device 100 is driven to rotate, the diagonal flow blades 120 and the centrifugal blades 130 rotate synchronously, the external air enters the air ducts 160 formed by the air deflector 200 and the hub 110 from the first air inlet 140, and enters the centrifugal cavity 111 from the second air inlet 112, and the air forms airflow when driven by the rotation of the diagonal flow blades 120 and the centrifugal blades 130. Due to the wall-adhering effect of the airflow, when the airflow in the centrifugal cavity 111 is discharged from the second air outlet 113, the airflow flows out along the inner wall of the hub 110, the airflow in the air ducts 160 is guided by the diagonal flow blades 120 and the air deflector, and the airflow formed by the rotation of the diagonal flow blades 120 is discharged from the first air outlet 150. The airflows formed by the diagonal flow blades 120 and the centrifugal blades 130 are blown towards the outside of the hub, and the airflows formed by the diagonal flow blades 120 and the centrifugal blades 130 converge after being discharged from the respective air outlets. Since the airflow formed by the diagonal flow blades 120 has a relatively large air volume and the airflow formed by the centrifugal blades 130 has a relatively large air pressure, the air volume and air pressure of the mixed airflow can be effectively increased after the two airflows converge.

The hub 110 is provided with the first air inlet 140 at the air inlet side thereof, and cooperates with the air deflector 200 to form the second air inlet 112. In this way, the air inlet area at the air inlet side of the hub 110 can be used fully to increase the air inlet volume, and there is no turbulence at the air inlet side of the hub 110, which facilitates the air entry to improve the working efficiency of the air outlet device. Moreover, the diagonal flow blades 120 and the centrifugal blades 130 can form two airflows respectively, and the two airflows converge after being discharged from the respective air outlets, which can effectively improve the air volume and air pressure of the air outlet device.

It is to be noted that a plurality of diagonal flow blades 120 and a plurality of centrifugal blades 130 can be disposed, the plurality of diagonal flow blades 120 are evenly distributed outside the hub 110. The plurality of diagonal flow blades 120 are combined to guide the air in the air ducts 160, the plurality of centrifugal blades 130 are evenly distributed inside the hub 110, and the plurality of centrifugal blades 130 are combined to guide the air in the centrifugal cavity 111, thus improving the air outlet efficiency of the combined blade device 100.

The shapes of the diagonal flow blades 120 and centrifugal blades 130 can be selected from conventional blade structures. The hub 110 adopts a tapered structure to facilitate diagonal air guide. The rotation of the diagonal flow blades 120 drives the air to make centrifugal and axial flow motions simultaneously and generate diagonal airflow. The gradually expanding shape of the hub 110 allows the air entering the air ducts 160 from the axial direction to be discharged from the radial periphery of the base 400 through the air guide of the diagonal flow blades 120, and allows the flowing direction of the airflow discharged from the diagonal flow blades 120 to be approximately parallel to the flowing direction of the airflow discharged from the centrifugal blades 130, which facilitates the convergence of the airflows and avoids turbulence generated after the convergence of the airflows.

The diagonal flow blades 120 are connected to the outside of the hub 110 in an inclined manner, so that the effective width of the diagonal flow blades 120 is wider, and the diagonal flow blades 120 may be spiral-shaped and be of a curved structure that conforms to a three-dimensional flow design.

Figure 4:
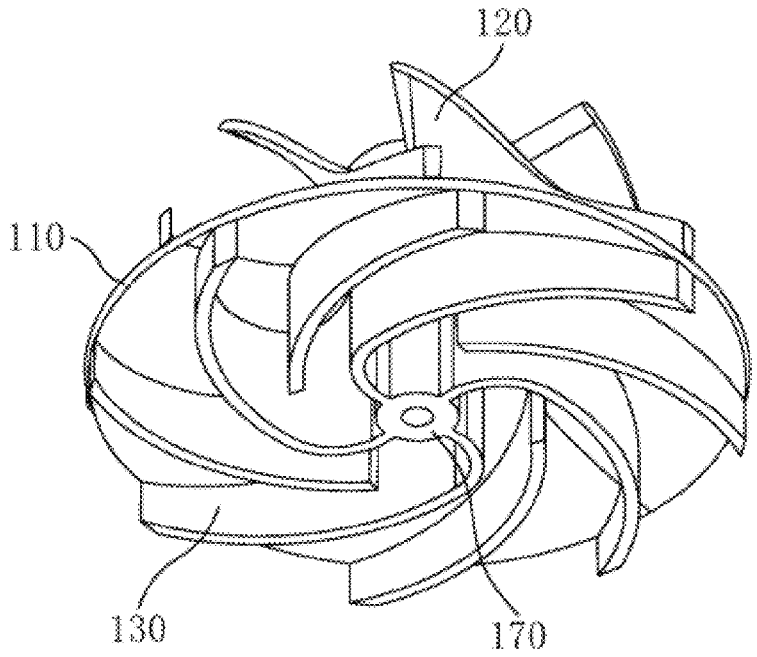
FIG. 4 is a schematic structural diagram showing a combined blade device according to other embodiments of the present disclosure.

As shown in FIG. 4, the combined blade device further includes an adapter part 170, ends of at least part of the centrifugal blades 130 that are away from the first air outlet 150 are connected to the adapter part 170. The adapter part 170 can be configured to connect a driving element for driving the combined blade device to rotate, or to mount an adapter plate connected to the driving element. The adapter part 170 is located in the centrifugal cavity 111, and the adapter part 170 can be configured in a columnar shape and is provided with a mounting hole for connecting an external component. It is to be noted that the adapter part 170 disposed at ends of the centrifugal blades 130, on the one hand, facilitates the assembly of the combined blade device and other components, and on the other hand, take up little space due to the simple structure of the adapter parts 170, such that the combined blade device can be manufactured in an integrated molding manner, thereby reducing the processing cost of the combined blade device.

As shown in FIG. 4, one adapter part 170 is disposed and located at the center of the centrifugal cavity 111, a plurality of centrifugal blades 130 are provided, and the ends of a part of the centrifugal blades 130 are connected to the adapter part 170, such that the combined blade device can be connected to the external component through the adapter part 170.

In some embodiments, the part of the centrifugal blades 130 connected to the adapter part 170 and the part of the centrifugal blades 130 not connected to the adapter part 170 are alternately spaced in the circumferential direction of the hub 110, which can increase the flowing smoothness of the airflow while reducing the processing difficulty, thus improving the air outlet efficiency of the combined blade device.

Figure 5:
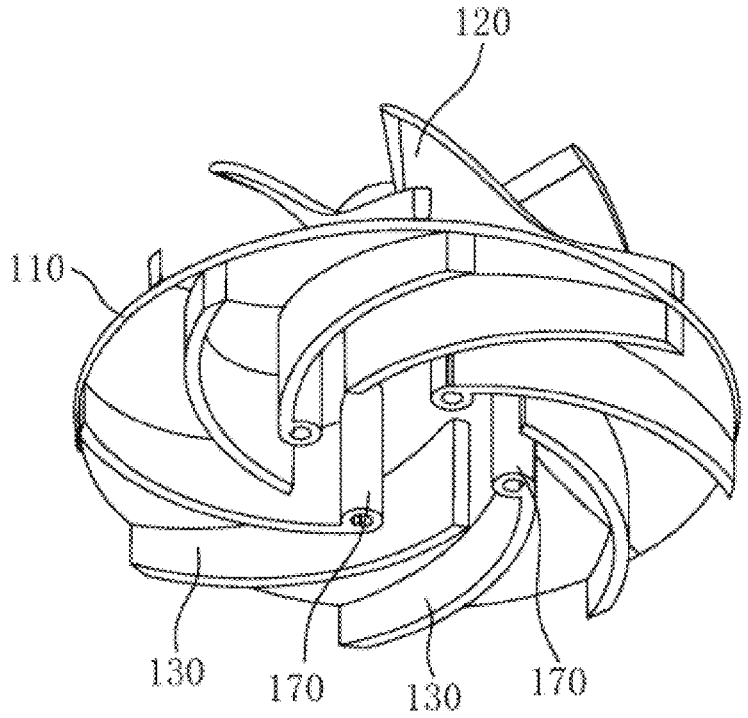
FIG. 5 is a schematic structural diagram showing a combined blade device according to some further embodiments of the present disclosure.

As shown in FIG. 5, a plurality of adapter parts 170 may be disposed at intervals, the center of a circumcircle for the plurality of adapter parts 170 is located on the rotating axis. In a plane perpendicular to the rotating axis of the centrifugal blades 130, the projections of the adapter parts 170 are located outside the projection of the first end of the hub 110, thus the adapter parts 170 do not affect the flowing of the airflow in the central area of the centrifugal cavity 111, making the airflow flow smoother, and improving the air outlet efficiency of the combined blade device.

In some embodiments, the plurality of adapter parts 170 are evenly spaced in the circumferential direction of the hub 110, and the part of the centrifugal blades 130 connected to the adapter parts 170 and the part of the centrifugal blades 130 not connected to the adapter parts 170 are evenly and alternately spaced in the circumferential direction of the hub 110. For example, four adapter parts 170, four centrifugal blades connected to the adapter parts 170 and four centrifugal blades not connected to the adapter parts 170 are provided, and the adjacent centrifugal blades 130 are evenly distributed at 450 in the circumferential direction. In this embodiment, by arranging two types of centrifugal blades 130 evenly spaced, the flowing smoothness of the airflow can be increased, the processing difficulty can be reduced, and the air outlet efficiency and air outlet stability of the combined blade device can be improved.

In some embodiments, the diagonal flow blades 120 are located in the air ducts 160 formed by the hub 110 and the air deflector 200, one side of each of the diagonal flow blades 120 is connected to the hub 110 while there is a gap between the other side and the air deflector 200, such that the diagonal flow blades 120 may rotate relative to the air deflector 200. The width of the diagonal flow blades 120 gradually decreases in the direction towards the first air outlet 150, when the gap between the diagonal flow blades 120 and the air deflector 200 remains unchanged, the air ducts 160 formed by the hub 110 and the air deflector 200 are also gradually decreased in width, the area enclosed by the first air outlet 150 is smaller than that enclosed by the first air inlet 140. After the air enters the air ducts 160 from the first air inlet 140, as the width of the air ducts 160 decreases, the pressure of the airflow continues to increase, which can enhance the air pressure of the airflow formed by the diagonal flow blades 120.

In addition, both sides of the centrifugal blades 130 are connected to the hub 110 and the base 400, respectively, the plurality of centrifugal blades 130 are evenly distributed around the rotating axis. The air entering the centrifugal cavity 111 from the second air inlet 112 flows in the radial direction of the base 400 from the center of the centrifugal cavity 111 as the rotation of the centrifugal blades 130, and is discharged from the second air outlet 113 at the outer edge of the base 400. Since the hub 110 gradually and externally expands in the flowing direction of the airflow, in order to facilitate the centrifugal blades 130 to guide the air and increase the air pressure of the airflow, the width of the centrifugal blades 130 gradually decreases in the direction from the center to the second air outlet 113, the width of the centrifugal blades 130 refers to the distance of the centrifugal blades 130 in the direction of the rotating axis. In this way, the gap between the hub 110 and the base 400 gradually decreases in the direction from the center to the second air outlet 113, which can effectively enhance the air pressure of the centrifugal airflow.

Figure 6:
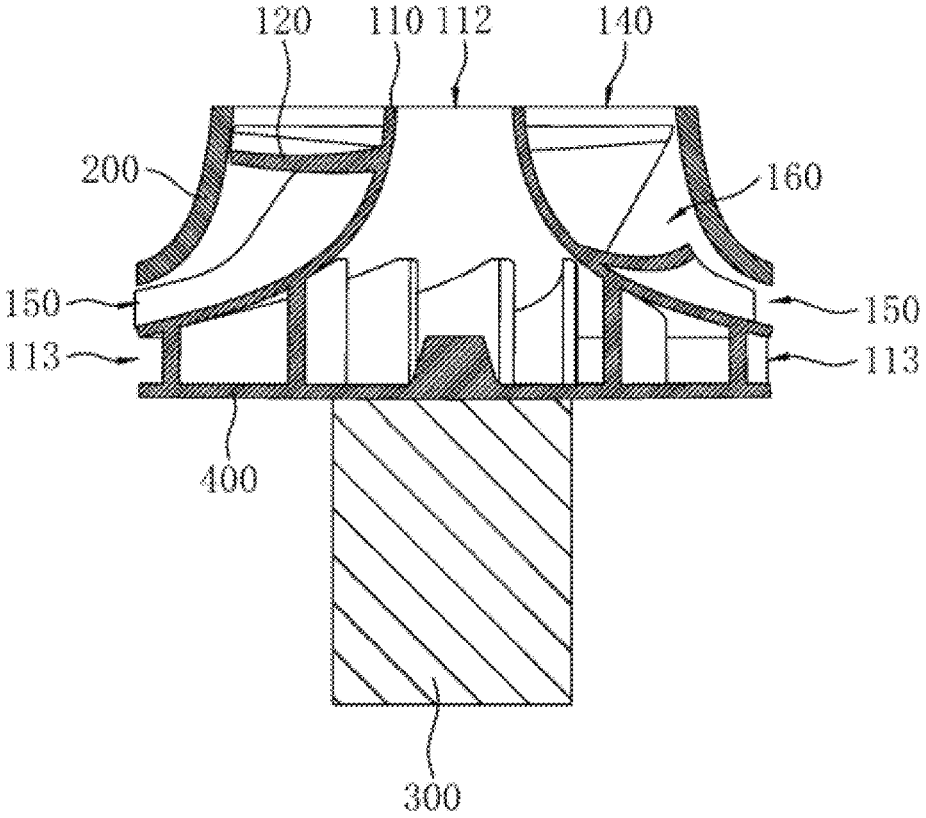
FIG. 6 is a cross-sectional view of a combined air outlet device according to some embodiments of the present disclosure.

Referring to FIG. 6, an embodiment of the present disclosure further provides a combined air outlet device, including the above-mentioned combined blade device 100, and further including an air deflector 200 and a driving element 300. At least part of the combined blade device 100 is arranged in the air deflector 200 which is disposed around the hub 110 and forms the air ducts 160 with the hub 110. The gap between the air deflector 200 and the first end of the hub 110 forms the first air inlet 140, and the first air inlet 140 is disposed around the second air inlet 112 to make full use of the air inlet area at the air inlet side of the air outlet device. The driving element 300 is connected to the combined blade device 100 and configured to drive the combined blade device 100 to rotate. The centrifugal blades 130 and the diagonal flow blades 120 rotate synchronously, and the generated airflows converge after being discharged from the first air outlet 150 and the second air outlet 113, to increase the air volume and air pressure of the air outlet device.

The combined air outlet device further includes a base 400, which is disposed close to the second end of the hub 110 and spaced apart from the hub 110. The base 400 is connected with the centrifugal blades 130 at one side away from the second air inlet 112, and the base 400 is configured to mount the driving element 300. The base 400 limits the air outlet area of the second air outlet 113 and guides the airflow in the centrifugal cavity 111 so that the airflow generated by the centrifugal blades 130 can be discharged towards the outside of the hub 110 to facilitate converging with the airflow generated by the diagonal flow blades 120.

Figure 7:
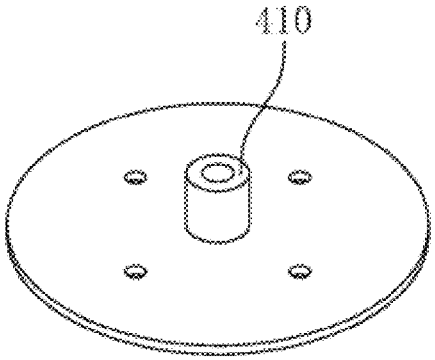
FIG. 7 is a schematic structural diagram showing a base in FIG. 6 according to some embodiments of the present disclosure.

The base 400 may be connected to the centrifugal blades 130 by way of bonding or welding, or may be connected to the centrifugal blades 130 by way of a detachable connection. In some embodiments, as shown in FIG. 7, the base 400 is in the shape of a flat plate, the base 400 is provided with assembly holes that match with the respective adapter parts 170. The adapter parts 170 are connected to the base 400 by way of threaded fastening, and compared with the bonding and welding connection methods, the assembly of the combined blade device and the base 400 as well as the later maintenance of the base 400 and the combined blade device can be simplified.

The center of the base 400 is provided with a protrusion 410 for mounting an output shaft of the driving element 300, the protrusion 410 can be accommodated among the plurality of adapter parts 170 to facilitate the connection between the driving element 300 and the combined blade device. Moreover, through the connection between the driving element 300 and the base 400, the driving element 300 can drive the entire combined blade device to rotate.

The edge of the base 400 that is away from the rotating axis may be retracted inwards in the direction of the rotating axis compared to the edge of the hub 110, or the edge of the base 400 may be flush with the edge of the second end of the hub 110 in the direction of the rotating axis. As shown in FIG. 6, both the end of the air deflector 200 that is close to the base 400 and the end of the hub 110 that is close to the base 400 are flush with the edge of the base 400. In this arrangement, the airflow discharged from the first air outlet 150 is discharged outwards in the radial direction of the base 400, the airflow discharged from the second air outlet 113 is discharged outwards in the radial direction of the base 400. After the two airflows converge, the mixed airflow flows towards the outside of the base 400 at the same time, so that the air outlet device achieves the effect of axial air inlet and circumferential air outlet. Compared with traditional centrifugal fans, the air volume and air pressure of the air outlet device are improved simultaneously, and the air outlet device can be applied to appliances with circumferential air outlet requirements such as vacuum cleaners and sweeping robots.

The hub 110 and the air deflector 200 are both tilted towards the base 400, and the airflow discharged from the second air outlet 113 still has a tendency to flow towards the base 400, which facilitates the airflow discharged from the second air outlet 113 to converge with the airflow discharged from the first air outlet 150. It is conceivable that one side of the hub 110 that is close to the first air outlet 150 and one side of the air deflector 200 that close to the second air outlet 113 can be as parallel as possible to the base 400 so that the airflow discharged from the first air outlet 150 may converge with the airflow discharged from the second air outlet 113 in the same direction, thus effectively reducing the risk of turbulence occurring when the airflows converge.

Figure 8:
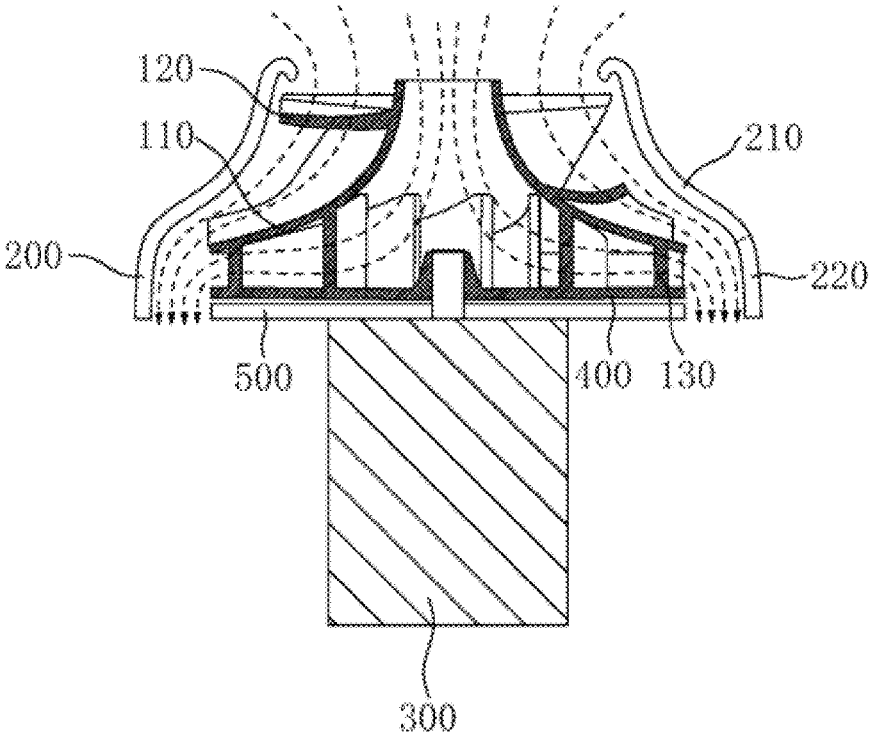
FIG. 8 is a cross-sectional view of a combined air outlet device according to other embodiments of the present disclosure.

As shown in FIG. 8, the air deflector 200 is provided with a first air guide section 210 and a second air guide section 220. The first air guide section 210 is disposed around the hub 110 and forms the air ducts 160 with the outside of the hub 110. The second air guide section 220 is disposed around the base 400 and has a gap with the outer edge of the base 400. The second air guide section 220 is configured to guide the airflows discharged from the first air outlet 150 and the second air outlet 113, the airflow discharged from the first air outlet 150 and the airflow discharged from the second air outlet 113 converge to form the mixed airflow. Due to being radially blocked by the second air guide section 220, the mixed airflow does not flow any more in the radial direction of the base 400, and under the guidance of the second air guide section 220, the mixed airflow continues to flow in the direction away from the air inlet.

It is conceivable that, in order to prevent the bending angle of the first air guide section 210 relative to the second air guide section 220 from being too large, resulting in noise at the joint therebetween, the second air guide section 220 may be designed to increase gradually the opening in the direction away from the air inlet, such that the second air guide section 220 is tilted at a certain angle relative to the rotating axis of the blades, to reduce the bending angle of the second air guide section 220 relative to the first air guide section 210.

Further, the inner surface of the joint between the first air guide section 210 and the second air guide section 220 is a curved surface, which gradually approaches the second air outlet 113 in the flowing direction of the airflow. By designing the connecting surface of the first air guide section 210 and the second air guide section 220 as a curved surface, the airflow can be prevented from gathering at the joint therebetween which would otherwise cause noise, and the resistance to the airflow can be prevented from increasing at the joint, so that the airflow can flow from the first air guide section 210 to the second air guide section 220 more smoothly. As the curved surface gradually approaches the second air outlet 113, the extension direction of the second air guide section 220 changes relative to the first air guide section 210, and the second air guide section 220 extends in a direction closer to the rotating axis of the blades, so as to guide the mixed fluid.

In addition, at least part of the second air guide section 220 is parallel to the rotating axis of the combined blade device 100. It is conceivable that the entire second air guide section 220 can be parallel to the rotating axis of the blades, or as the second air guide section 220 gradually bends relative to the first air guide section 210, the portion of the second air guide section 220 that is away from the first air guide section 210 is bent to be parallel to the rotating axis of the blades. Under the guidance of the second air guide section 220, the mixed airflow flows in a direction parallel to the rotating axis of the blades. In this arrangement, the effect of axial air inlet and axial air outlet of the air outlet device can be achieved. Compared with traditional axial flow fans, the air volume and air pressure of the air outlet device are increased simultaneously, and the air outlet device can be applied to appliances with axial air outlet requirements such as fans, hair dryers.

Figure 9:
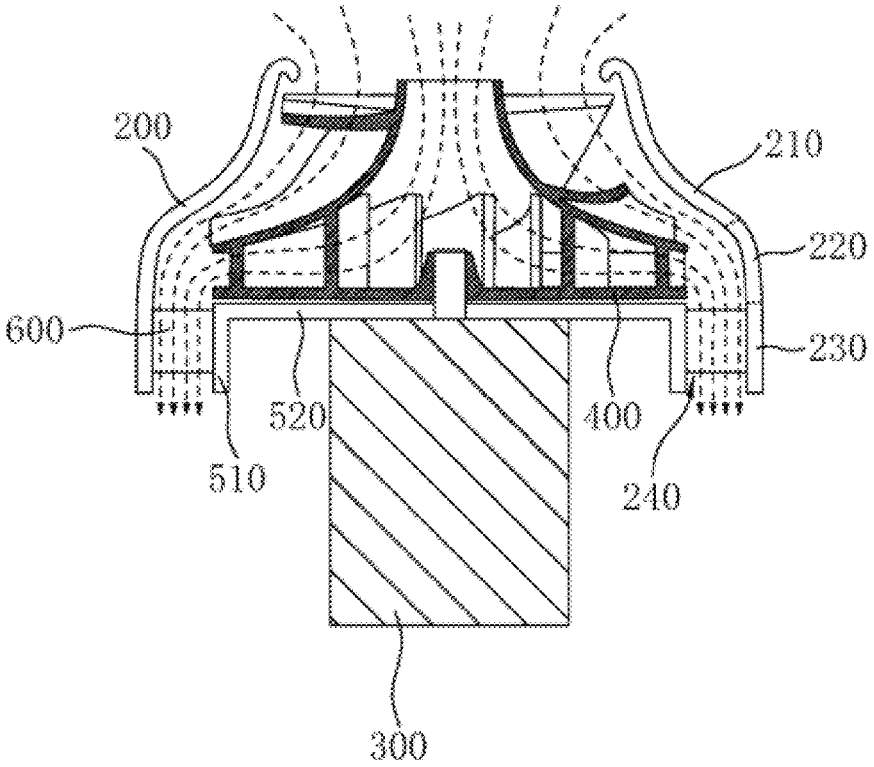
FIG. 9 is a cross-sectional view of a combined air outlet device according to some further embodiments of the present disclosure.

Further, as shown in FIG. 9, the combined air outlet device further includes a mounting seat 500 connected to the base 400 that is away from the hub 110. The air deflector 200 further includes a third air guide section 230 connected to one end of the second air guide section 220 that is away from the first air inlet 140. The third air guide section 230 is disposed around the mounting seat 500. The third air guide section 230 and a part of the mounting seat 500 are both parallel to the rotating axis of the combined blade device 100, the third air guide section 230 is combined with the mounting seat 500 to guide the mixed airflow, and a guiding distance to the mixed airflow is extended in an axial direction, allowing the mixed airflow to flow out of the air deflector 200 in the axial direction.

Figure 10:
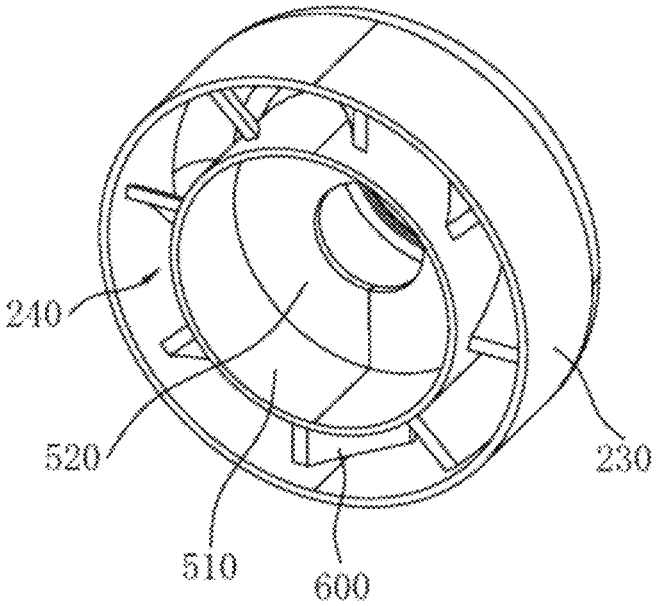
FIG. 10 is a schematic structural diagram showing the combined air outlet device in FIG. 8 according to some embodiments of the present disclosure.

Specifically, referring to FIGS. 9 and 10, the mounting seat 500 includes a drainage part 510 and a mounting part 520, the mounting part 520 is located on one side of the base 400 that is away from the hub 110, the drainage part 510 is integrally connected to the outer edge of the mounting part 520 that is away from the rotating axis and extends in the direction away from the base 400. The drainage part 510 is parallel to the rotating axis of the blades and combined with the third air guide section 230 to guide the mixed airflow. The mounting part 520 is configured to mount the driving element 300, and the driving element 300 may be a motor. The driving element 300 is fixed to the mounting part 520, an output end of the driving element 300 is connected to the base 400 and provides power to the combined blade device 100 for the blades to rotate and form the airflow.

Figure 11:
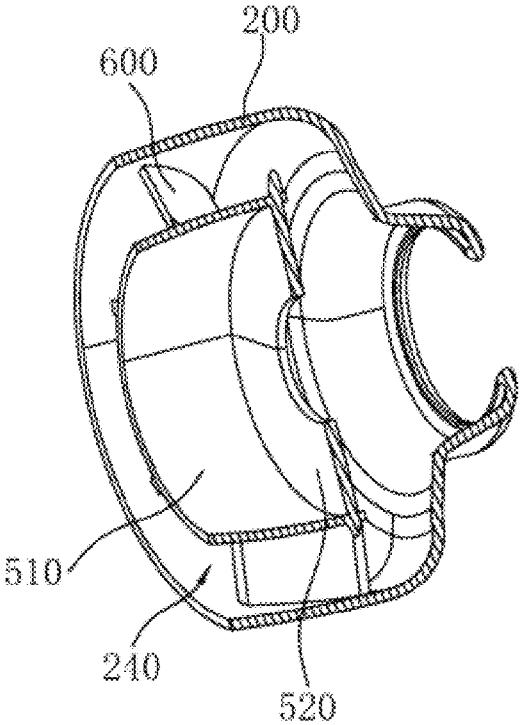
FIG. 11 is a cross-sectional view of an air deflector in FIG. 9 according to some embodiments of the present disclosure.

Referring to FIGS. 9 to 11, the combined air outlet device further includes guide vanes 600, an air guide cavity 240 is formed between the third air guide section 230 and the drainage part 510, the guide vanes 600 are accommodated in the air guide cavity 240, connected between the third air guide section 230 and the mounting seat 500, extend in a direction away from the base 400, and are configured to guide the mixed airflow entering the air guide cavity 240, to improve the air outlet uniformity of the air outlet device.

A plurality of guide vanes 600 may be disposed and evenly distributed around the mounting part 520. The guide vanes 600 may be disposed as flat plates or spiral plates, both sides of the guide vanes 600 in the radial direction of the base 400 are connected to the third air guide section 230 and the drainage part 510, respectively, to ensure the structural strength and connection stability of the guide vanes 600 and prevent the vibration of the guide vanes 600 from generating noise.

The embodiments of the present disclosure are described in detail above in combination with the drawings, but the present disclosure is not limited to the above embodiments. On the premise of not departing from the purpose of the present disclosure, various changes may also be made within the knowledge scope of those of ordinary skills in the art. In addition, the embodiments in the present disclosure and features in the embodiments may be combined with each other without conflict.

What is claimed is:

1. A combined air outlet device, comprising:

a combined blade device comprising:

a hub, wherein a first air inlet is formed outside an edge of a first end of the hub, and a first air outlet is formed outside an edge of a second end of the hub, the hub is internally provided with a centrifugal cavity, the first end of the hub is provided with a second air inlet, the first air inlet surrounds the second air inlet, the second end of the hub is provided with a second air outlet, both the second air inlet and the second air outlet are communicated with the centrifugal cavity, and the hub expands gradually in a direction from the second air inlet to the second air outlet;

at least one diagonal flow blade, connected to one side of the hub that is away from the centrifugal cavity;

a plurality of centrifugal blades, connected to the hub and located in the centrifugal cavity, wherein rotating axes of the at least one diagonal flow blade and the at least one centrifugal blade coincide with each other;

an air deflector in which at least part of the combined blade device is arranged;

a driving element connected to the combined blade device and configured to drive the combined blade device to rotate; and a base, wherein the base is connected to one side of the plurality of centrifugal blades that are away from the second air inlet, and configured to mount the driving element;

wherein the air deflector is provided with a first air guide section and a second air guide section, the first air guide section is disposed around the hub, the second air guide section is disposed around the base and blocks the second air outlet in a radial direction of the hub, and the second air guide section is configured to guide airflows discharged from the first air outlet and the second air outlet.

2. The combined air outlet device according to claim 1, wherein an area enclosed by the air deflector and the outside of the edge of the first end of the hub is the first air inlet, and an area enclosed by the air deflector and the outside of the edge of the second end of the hub is the first air outlet.

3. The combined air outlet device according to claim 1, wherein an edge of the base that is away from the rotating axis is flush with the second end of the hub in a direction of the rotating axis.

4. The combined air outlet device according to claim 1, wherein an inner surface of a joint of the first air guide section and the second air guide section is a curved surface, and the curved surface gradually approaches the second air outlet in the flowing direction of the airflow.

5. The combined air outlet device according to claim 1, further comprising a mounting seat, wherein the mounting base is connected to one side of the base that is away from the hub, the air deflector further comprises a third air guide section connected to one end of the second air guide section that is away from the first air inlet, the third air guide section is disposed around the mounting seat, and both the third air guide section and a part of the mounting seat are parallel to the rotating axis.

6. The combined air outlet device according to claim 5, wherein the mounting seat comprises a drainage part and a mounting part, the mounting part is connected to one side of the base that is away from the hub, the drainage part is connected to an outer edge of the mounting part that is away from the rotating axis, and the drainage part is parallel to the rotating axis and extends in a direction away from the base.

7. The combined air outlet device according to claim 5, further comprising guide vanes, wherein an air guide cavity is formed between the third air guide section and the mounting seat, and the guide vanes are accommodated in the air guide cavity and connected between the third air guide section and the mounting seat.

8. The combined air outlet device according to claim 1, wherein the combined blade device further comprises an adapter part, ends of at least part of the plurality of centrifugal blades that are away from the first air outlet are connected to the adapter part.

9. The combined air outlet device according to claim 8, wherein a part of the plurality of centrifugal blades connected to the adapter part and a part of the plurality of centrifugal blades not connected to the adapter part are spaced alternately in a circumferential direction of the hub.

10. The combined air outlet device according to claim 8, wherein a plurality of adapter parts are provided and distributed at intervals, and in a plane perpendicular to the rotating axis of the plurality of centrifugal blades, projections of the plurality of adapter parts are located outside a projection of the first end of the hub.

11. The combined air outlet device according to claim 10, wherein the plurality of adapter parts are evenly spaced in the circumferential direction of the hub.

* * * * *